US008975834B2

(12) United States Patent
Chen et al.

(10) Patent No.: US 8,975,834 B2
(45) Date of Patent: Mar. 10, 2015

(54) CONTROL CIRCUIT AND ILLUMINATING DEVICE HAVING DIFFERENT OPERATION MODES

(71) Applicant: OSRAM GmbH, Munich (DE)

(72) Inventors: Shaoping Chen, Guangdong (CN); Yuli Chen, Guangdong (CN); Jin Hu, Guangdong (CN); Jing Lin, Guangdong (CN)

(73) Assignee: OSRAM GmbH, Munich (DE)

( * ) Notice: Subject to any disclaimer, the term of this patent is extended or adjusted under 35 U.S.C. 154(b) by 91 days.

(21) Appl. No.: 13/742,408

(22) Filed: Jan. 16, 2013

(65) Prior Publication Data

US 2013/0181616 A1 Jul. 18, 2013

(30) Foreign Application Priority Data

Jan. 16, 2012 (CN) ..... 2012 1 0013171

(51) Int. Cl.
*H05B 37/02* (2006.01)

(52) U.S. Cl.
USPC ..... 315/307; 315/291; 315/185 S; 315/312; 315/247

(58) Field of Classification Search
USPC ..... 315/149–159, 247, 224, 225, 291, 315/307–326, 185 S
See application file for complete search history.

(56) References Cited

U.S. PATENT DOCUMENTS

| | | | | |
|---|---|---|---|---|
| 5,895,986 | A * | 4/1999 | Walters et al. | 307/117 |
| 6,144,161 | A * | 11/2000 | Kimmich et al. | 315/159 |
| 8,564,205 | B2 * | 10/2013 | Roberts et al. | 315/82 |
| 2011/0043137 | A1 * | 2/2011 | Negley et al. | 315/297 |

* cited by examiner

*Primary Examiner* — Tuyet Thi Vo

(57) ABSTRACT

The present invention relates to a control circuit for an illuminating device, characterized in that the control circuit comprises a detecting unit, a central control unit and an illumination mode control unit, the detecting unit detects ambient brightness and generates a detection signal, the central control unit controls the illumination mode control unit, according to the detection signal, to generate a plurality of first driving signal enabling the illuminating device to operate in a first illumination mode or a plurality of second driving signal enabling the illuminating device to operate in a second illumination mode. The control circuit can automatically adjust the illuminating device to be in different operation modes according to different ambient brightness.

18 Claims, 3 Drawing Sheets

CONTROL CIRCUIT AND ILLUMINATING DEVICE HAVING DIFFERENT OPERATION MODES

RELATED APPLICATIONS

This application claims priority to Chinese Patent Application Serial No. 201210013171.9, which was filed on Jan. 16, 2012, and is incorporated herein by reference in its entirety.

TECHNICAL FIELD

The present disclosure relates to a control circuit and an illuminating device.

BACKGROUND

In the current illumination market, especially in indoor illumination, the illuminating devices usually reach maximum brightness within 1 second. In the daytime, such illuminating devices are suited to people, but at night, the brightness changes dramatically at a time point when the illuminating device is turned on and turned off, as a result, it is hard for human eyes to be adapted to such dramatic change, and people's eye pupils will constrict abruptly. If the brightness is increased too quickly, temporary blindness might be caused. Therefore, this result is undesirable. In the evening, when illumination is necessary to see, illumination must be turned on in order to perform activities, or move within a darkened area, especially for children and the elderly. Also in such a case, abrupt illumination may be undesirable or damaging.

Some solutions, for instance, an adjustor arranged on the wall or a remote control used to control different illumination modes, may be implemented. But by means of these solutions, the light output only can be manually controlled.

SUMMARY

Therefore, various embodiments provide a control circuit for an illuminating device. The control circuit can adjust, according to the ambient brightness, the illuminating device to be in different operation modes, so that users' requirements are better met. In addition, various embodiments of the control circuit may have the advantages of a compact structure and a low cost.

Various embodiments provide a control circuit for an illuminating device, characterized in that the control circuit includes a detecting unit, a central control unit and an illumination mode control unit, the detecting unit detects ambient brightness and generates a detection signal, the central control unit controls the illumination mode control unit, according to the detection signal, to generate a plurality of first driving signal enabling the illuminating device to operate in a first illumination mode or a plurality of second driving signal enabling the illuminating device to operate in a second illumination mode. In the disclosed embodiments, the requirements to auto detection and auto control of the illumination mode are met by using the detecting unit and the illumination mode control unit.

According to various embodiments, the first illumination mode is a daylight operation mode, and in the daylight operation mode, the first driving signal drives the illuminating device to be turned on or turned off within less than 1 second at a time point when the illuminating device is turned on or turned off, i.e., one illumination mode thereof is the same as the traditional illumination mode of the illuminating device.

According to various embodiments, the second illumination mode is a night operation mode, and in the night operation mode, the second driving signal drives the illuminating device to be turned on or turned off in such a manner that brightness is changed gradually at a time point when the illuminating device is turned on or turned off. This mode that brightness is changed gradually is also called "soft illumination mode" and especially conforms to the nighttime environment and people's requirements at night.

According to various embodiments disclosed, when the detection signal is smaller than a first preset value, the central control unit controls the illumination mode control unit to enable the illuminating device to operate in a daylight operation mode, and when the detection signal is bigger than the first preset value, the central control unit controls the illumination mode control unit to enable the illuminating device to operate in a night operation mode. Upon comparison with the first preset value, different judgments are made based on different detection signals; as a result, different control signals by which the central control unit controls the illumination mode control unit are generated.

According to various embodiments, the detecting unit includes a first serial branch formed by a photoresistive element and a voltage-dividing resistor that are serially connected for detecting the ambient brightness, and the first serial branch has one terminal connected to a power supply voltage and the detection signal can be obtained from the node between the photoresistive element and the voltage-dividing resistor. Consequently, the ambient brightness can be detected by using a photoconductive element, in other words, a photoresistive element, and a voltage-dividing resistor.

According to various embodiments disclosed, the central control unit receives and compares an operation voltage and a reference voltage representing a current driving current of a load and generates, according to a comparison result, the first or the second driving signal, wherein the illumination mode control unit is a reference voltage adjusting circuit for adjusting the reference voltage. In the solution in which the driving signal is generated based on the comparison result between the operation voltage and the reference voltage representing the current driving current of the load, in order to generate different driving signals, in this preferred solution, the illumination mode control unit is a reference voltage adjusting circuit and generates different driving signals by adjusting different reference voltages.

According to various embodiments, the reference voltage adjusting circuit controls the reference voltage to be increased gradually at a time point when the illuminating device is turned on in a night operation mode, and controls the reference voltage to be decreased gradually at a time point when the illuminating device is turned off in the night operation mode. As a result, a driving current of the illuminating device finally is also increased or decreased gradually as controlled by the central control unit.

According to various embodiments, the reference voltage adjusting circuit includes a first control circuit and a second control circuit, and the central control unit, according to the detection signal, sends a first control signal having variable values to the first control circuit and sends a second control signal having variable values to the second control circuit. Via different combinations of values of the first control signal and the second control signal, it is realized that the reference voltage values are adjusted differently by the reference voltage adjusting circuit in the daylight operation mode at a time point when the illuminating device is turned on or off and in the night operation mode at a time point when the illuminating device is turned on or off.

According to various embodiments, the first control circuit and the second control circuit share a second serial branch formed by a first resistor and a second resistor that are serially connected, and a node between the first resistor and the second resistor is a reference voltage sample terminal connected to the central control unit.

According to various disclosed embodiments, the second control circuit further includes the second serial branch, a second transistor and a first capacitor, the first capacitor has one terminal connected to an operation electrode of the second transistor and the other terminal connected to the reference voltage sample terminal, the second transistor has a control electrode connected to the central control unit and a reference electrode connected to a reference potential, and the second transistor receives the second control signal. The second transistor is enabled or disenabled according to different values of the second control signal.

According to further disclosed embodiments, the first control circuit further includes a first transistor, a second capacitor and a fourth resistor, the second capacitor has one terminal connected to a control electrode of the first transistor and the other terminal connected to the reference potential, the control electrode of the first transistor is connected to one terminal of the fourth resistor and the other terminal of the fourth resistor is connected to the central control unit, and the first transistor has a reference electrode connected to the reference potential and an operation electrode connected to the reference voltage sample terminal, and the first transistor receives the first control signal. By controlling the control electrode of the first transistor by means of the second capacitor and the fourth resistor, it is realized that the first transistor is enabled and disenabled according to different values of the first control signal.

According to various embodiments, when the illuminating device is turned on in such a manner that brightness is increased gradually and turned off in such a manner that brightness is decreased gradually, a change tendency chart of the reference voltage is one selected from a linear change chart, a curve change chart and a zigzag change chart. Of course, it can be other change chart according to different requirements. As a result, different requirements in different situations to the mode that brightness is increased gradually or the mode that brightness is decreased gradually can be satisfied.

According to various embodiments, in the night operation mode, at a time point when the illuminating device is turned on, the central control unit sends a first control signal having a low-level value to the first transistor and sends a second control signal having a high-level value to the second transistor, and at a time point when the illuminating device is turned off, the central control unit sends a first control signal having a preset-level value to the first transistor and sends a second control signal having a high-level value to the second transistor. Therefore, in the night operation mode, at the time point when the illuminating device is turned on, the first transistor is disenabled, the second transistor is enabled, and it is realized that the reference voltage is controlled to be increased gradually by means of the first capacitor, the first resistor and the second resistor of the second control circuit. At the time point when the illuminating device is turned off, as the reference voltage previously always has the maximum reference voltage value, when the first transistor is partially enabled, the reference voltage value is decreased by gradually dividing current at the maximum reference voltage by using the second capacitor and the fourth resistor. At this time, the first transistor is controlled by the preset-level value. The preset-level value depends upon requirements of the designer to the speed of darkening. It should be noted that here the "low-level" or "high-level" refers to the voltage level of the first and second control signal.

According to various embodiments, in the daylight operation mode, at a time point when the illuminating device is turned on, the central control unit sends a first control signal having a low-level value to the first transistor and sends a second control signal having a low-level value to the second transistor, and at a time point when the illuminating device is turned off, the central control unit sends a first control signal having a high-level value to the first transistor and sends a second control signal having a low-level value to the second transistor. Therefore, in the daylight operation mode, at the time point when the illuminating device is turned on, the first transistor is disenabled, the second transistor is disenabled, and the reference voltage is increased quickly to the maximum reference voltage value. At the time point when the illuminating device is turned off, as the reference voltage previously always has the maximum reference voltage value, then when the first transistor is enabled, the reference voltage is decreased quickly to zero.

According to various embodiments, the central control unit is an MCU. Therefore, existing components and parts of the illuminating device are used.

According to various embodiments, the central control unit and the illumination mode control unit are integrated into one chip, thus the manufacturing is convenient and the cost is reduced.

The disclosed embodiments further relate to an illuminating device.

The control circuit and the illuminating device of the present disclosure can overcome the defects in the prior art, can automatically adjust the illuminating device to be in different operation modes according to different ambient brightness, and therefore better satisfies user's requirements. In addition, the control circuit of the present disclosure has the advantages of a compact structure and a low cost.

It shall be understood that both the above general description and the following detailed description are for illustrative and explanative purposes in order to provide further description of aspects of the presently disclosed embodiments.

BRIEF DESCRIPTION OF THE DRAWINGS

The accompanying drawings constitute a part of the present description and are used to provide further understanding of the disclosed embodiments. Such accompanying drawings illustrate the embodiments disclosed and are used to describe the principles of the disclosed embodiments together with the description. In the accompanying drawings the same components are represented by the same reference numbers. As shown in the drawings.

The following detailed description refers to the accompanying drawings that show, by way of illustration, specific details and embodiments in which the embodiments disclosed herein may be practiced.

DETAILED DESCRIPTION

Figure 1:
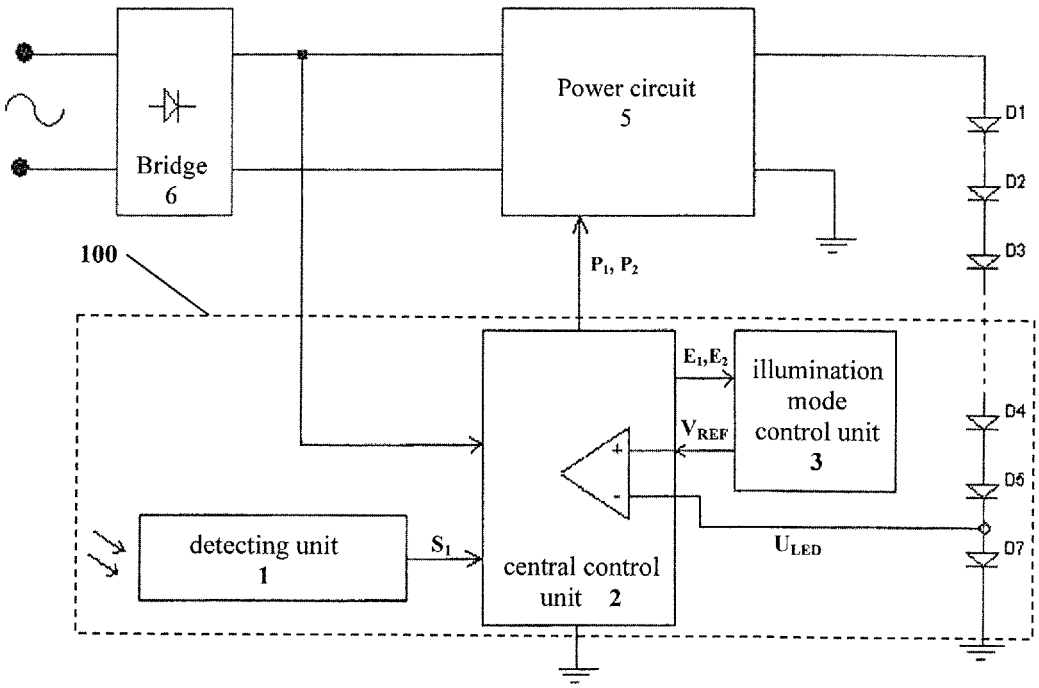
FIG. 1 is a block diagram of a control circuit of a first exemplary embodiment according to an embodiment.
Figure 2A:
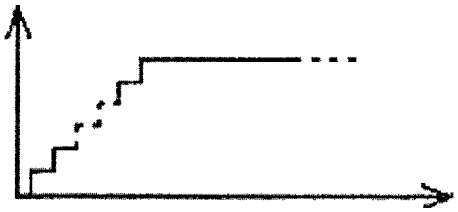
FIGS. 2A-2F are change tendency charts of a reference voltage in a reference voltage adjusting circuit in a control circuit in different embodiments at a time point when an illuminating device is turned on or turned off.
Figure 2D:
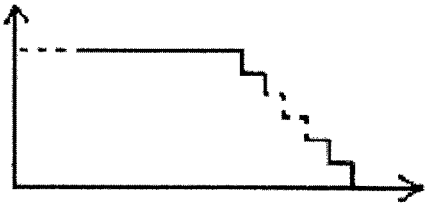
Figure 2B:
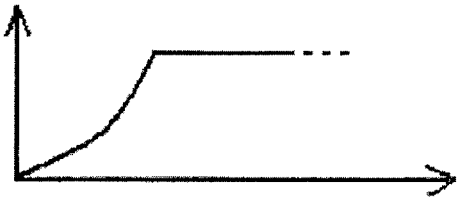
Figure 2E:
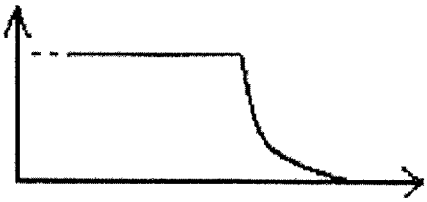
Figure 2C:
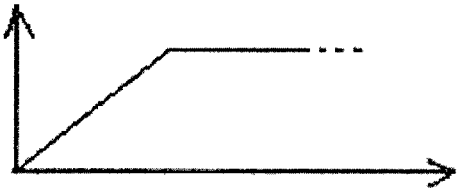
Figure 2F:
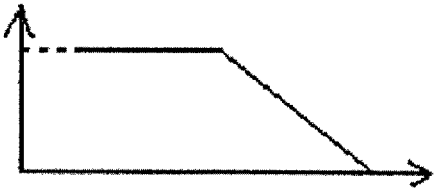

FIG. 1 is a block diagram of a control circuit 100 of a first exemplary embodiment according to the present disclosure. The control circuit 100 of the present embodiments comprise a detecting unit 1, a central control unit 2 and an illumination mode control unit 3. Moreover, the detecting unit 1 detects ambient brightness and generates a detection signal $S_1$, and transmits the detection signal $S_1$ to the central control unit 2. The central control unit 2 generates a first control signal E1 and a second control signal E2 according to the detection signal $S_1$, and sends the first control signal E1 and the second control signal E2 to the illumination mode control unit 3. The central control unit 2 further generates, according to a reference voltage $V_{REF}$ in the illumination mode control unit 3, a plurality of first driving signal $P_1$ enabling an illuminating device 10 to operate in a first illumination mode or a plurality of second driving signal $P_2$ enabling the illuminating device 10 to operate in a second illumination mode. The disclosed control circuit 100 is used in a driving circuit, for instance, abridge 6 is provided upstream from the central control unit 2 and a power circuit 5 is provided downstream from the central unit 2 to further adjust a driving current in the loads D1, . . . D7 according to the first driving signal $P_1$ or the second driving signal $P_2$.

It should be indicated that in the present exemplary embodiment, the driving signal to be output to the power circuit 5 usually is generated in the following manner: the central control unit 2 receives and compares an operation voltage $U_s$ and a reference voltage $V_{REF}$ representing a current driving current of the loads and generates the driving signal according to a comparison result. Therefore, in the present exemplary embodiment, the illumination mode control unit 3 is a reference voltage adjusting circuit for adjusting the reference voltage $V_{REF}$. The central control unit 2 realizes adjustment of the first driving signal $P_1$ and the second driving signal $P_2$ based on adjustment of the reference voltage $V_{REF}$.

When the control circuit 100 outputs the first driving signal $P_1$, the loads D1, . . . D7 are enabled to operate in the first illumination mode, namely, a daylight operation mode. And when the second driving signal $P_2$ is output, the loads D1, . . . D7 are enabled to operate in the second illumination mode, namely, a night operation mode. In the disclosed embodiments, the difference between the daylight operation mode and the night operation mode mainly reflects at the time point when the loads are turned on or turned off. In the daylight operation mode, at the time point when the illuminating device 10 is turned on or turned off, the first driving signal $P_1$ drives the illuminating device 10 to be turned on or turned off within less than 1 second. In the night operation mode, at the time point when the illuminating device 10 is turned on or turned off, the second driving signal $P_2$ drives the illuminating device 10 to be turned on or turned off in a mode that brightness is changed gradually, namely, a soft illumination mode. Consequently, different requirements in different situations are satisfied.

Figure 3:
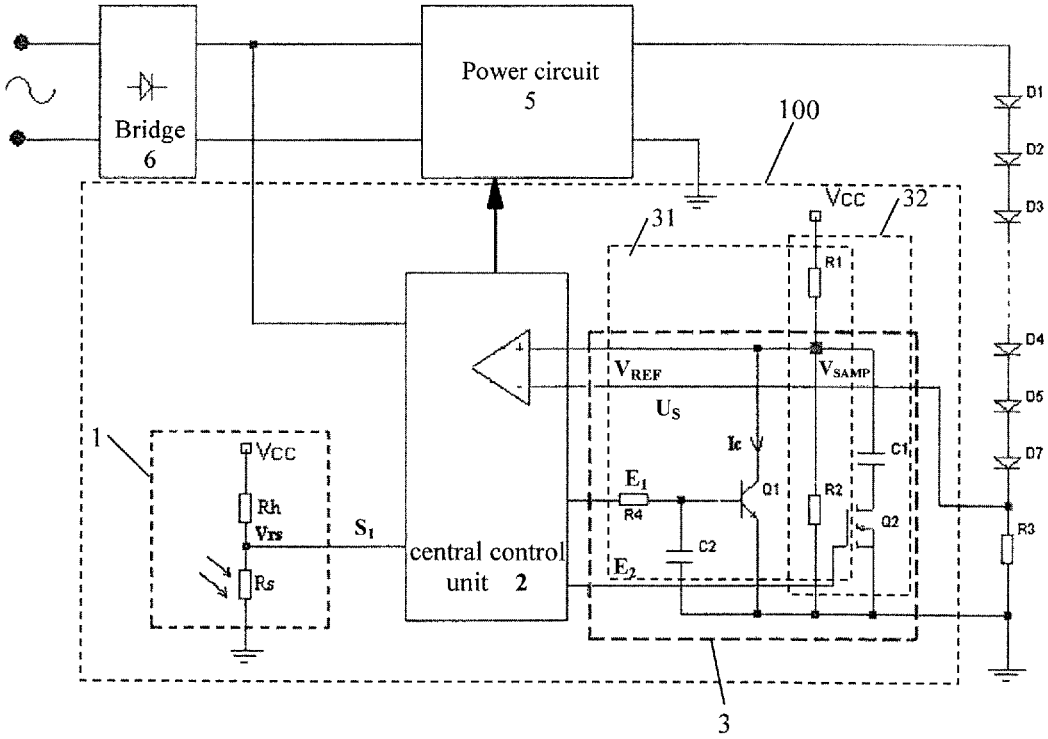
FIG. 3 is a circuit diagram of a control circuit of an exemplary embodiment.

FIGS. 2A-2C and FIGS. 2D-2E are change tendency charts of the reference voltage in the reference voltage adjusting circuit in the disclosed control circuit in different embodiments at a time point when the illuminating device 10 is turned on or turned off; and FIG. 3 shows a control circuit of a first exemplary embodiment.

It can be seen, by combining FIGS. 2A-2C and FIGS. 2D-2E with FIG. 3, that in the first exemplary embodiment, the detecting unit 1 includes a first serial branch formed by a photoresistive element Rs and a voltage dividing resistor Rh serially connected for detecting the ambient brightness, the first serial branch has one terminal connected to a power supply voltage Vcc and obtains the detection signal $S_1$ from between the photoresistive element Rs and the voltage dividing resistor Rh. As specifically shown in FIG. 3, light is incident on the photoresistive element Rs, at which time, a voltage between the photoresistive element Rs and the voltage dividing resistor Rh is detected by the central control unit 2. At this time, a value of the detection signal $S_1$ is $$Vrs = \frac{Rs}{Rs + Rh} * Vcc.$$

If it is at night, a small amount of light is incident on the photoresistive element Rs, resulting in a big value of the photoresistive element Rs. The value Vrs of the detection signal $S_1$ is close to that of the power supply voltage Vcc. If it is in the daytime, a large amount of light is incident on the photoresistive element Rs, resulting in a small value of the photoresistive element Rs. The value Vrs of the detection signal $S_1$ is smaller than that of the power supply voltage Vcc. At the moment, a first preset value can be provided. When the value Vrs of the detection signal $S_1$ is smaller than the first preset value, the central control unit 2 controls values of the first control signal E1 and the second control signal E2 to control the illuminating device 10 to enter into the first illumination mode. In particular, in the daylight operation mode as the first illumination mode, at a time point when the illuminating device 10 is turned on, the central control unit 2 outputs the first control signal E1 having a low-level value and a second control signal E2 having a low-level value to control a first transistor Q1 and a second transistor Q2 not to be enabled in a first control circuit 31 and a second control circuit 32 in the reference voltage adjusting circuit, and thus to realize quick turn-on. At a time point when the illuminating device 10 is turned off, the central control unit 2 outputs a first control signal E1 having a high-level value and a second control signal E2 having a low-level value to control the first transistor Q1 to be enabled and the second transistor Q2 not to be enabled in the first control circuit 31 and the second control circuit 32 in the reference voltage adjusting circuit.

When the value Vrs of the detection signal $S_1$ is bigger than the first preset value, the central control unit 2 controls values of the first control signal E1 and the second control signal E2 to control the illuminating device 10 to enter into the second illumination mode. In particular, in the night operation mode as the second illumination mode, at a time point when the illuminating device 10 is turned on, the central control unit 2 outputs the first control signal E1 having a low-level value and the second control signal E2 having a high-level value to control the first transistor Q1 not to be enabled and the second transistor Q2 to be enabled in the first control circuit 31 and the second control circuit 32 in the reference voltage adjusting circuit, and thus to realize gradual turn-on. At a time point when the illuminating device 10 is turned off, the central control unit 2 outputs the first control signal E1 having a preset-level value and the second control signal E2 having a high-level value to control the first transistor Q1 to be partially enabled and the second transistor Q2 to be enabled in the first control circuit 31 and the second control circuit 32 in the reference voltage adjusting circuit, and thus to realize gradual darkening. As to the photoresistive element, in other words, photoconductive element, various photoconductive elements can be applied to the detecting unit of variously disclosed embodiments.

It can be seen, by combining FIGS. 2A-2C and FIGS. 2D-2E with FIG. 3, that the reference voltage adjusting circuit of the present embodiment includes the first control circuit 31 and the second control circuit 32. The first control circuit 31 and the second control circuit 32, at the time point when the illuminating device 10 is turned on, control the reference voltage $V_{REF}$ to be increased gradually in a soft-start situation, and control the reference voltage $V_{REF}$ to be decreased gradually in a soft-close situation. Changes of the reference voltage $V_{REF}$ may be different curves according to different applications, such as linear change chart, curve change chart and zigzag change chart as shown in FIG. 2. The changes of the reference voltage $V_{REF}$ above reflect changes of a driving current of a final load.

In the present exemplary embodiment, the reference voltage adjusting circuit includes a second serial branch formed by the first resistor R1 and the second resistor R2 serially connected, the second serial branch is connected to the power supply voltage Vcc, and a node between the first resistor R1 and the second resistor R2 is a reference voltage sampling terminal $V_{SAMP}$ connected to the central control unit 2. A maximum value of the reference voltage $V_{REF}$ in the reference voltage sampling terminal $V_{SAMP}$ is Vrefrating=Vcc*R2/(R1+R2). The second serial branch is shared by the first control circuit 31 and the second control circuit 32.

Next, components of the first control circuit 31 and the second control circuit 32 will be introduced in detail. The second control circuit 32, apart from disclosing the second serial branch, further includes the second transistor Q2 and the first capacitor C1, wherein the first capacitor C1 has one terminal connected to an operation electrode of the second transistor Q2 and the other terminal connected to the reference voltage sampling terminal $V_{SAMP}$, the second transistor Q2 has a control electrode connected to the central control unit 2 and a reference electrode connected to the reference potential. The first control circuit 31, apart from including the second serial branch, further includes the first transistor Q1, the second capacitor C2 and the fourth resistor R4, wherein the second capacitor C2 has one terminal connected to a control electrode of the first transistor Q1 and the other terminal connected to the reference potential, the control electrode of the first transistor Q1 is connected to one terminal of the fourth resistor R4, and the other terminal of the fourth resistor R4 is connected to the central control unit 2, the first transistor Q1 has a reference electrode connected to the reference potential and an operation electrode connected to the reference voltage sampling terminal $V_{SAMP}$.

At a time point when the illuminating device 10 is turned on, the central control unit 2 chooses the daylight operation mode according to a situation that the detecting unit 1 detects the ambient brightness. When the central control unit 2 chooses the daylight operation mode, at a time point of turn-on, the second transistor Q2 receives the second control signal E2 having a low-level value and the first transistor Q1 receives the first control signal E1 having a low-level value, therefore, the first transistor Q1 and the second transistor Q2 are disenabled. The first capacitor C1 and the second transistor Q2 are serially connected, i.e., parasitic capacitances of the first capacitor C1 and the second transistor Q2 are serially connected, and the serial branch including the first capacitor C1 and the second transistor Q2 are connected in parallel with the second resistor R2. As the parasitic capacitance of the second transistor Q2 is quite small, the time of increasing the reference voltage $V_{REF}$ in the reference voltage sampling terminal $V_{SAMP}$ is slightly affected. When the illuminating device 10 is turned on, the value of the reference voltage $V_{REF}$ in the reference voltage sampling terminal $V_{SAMP}$ is quickly increased, i.e., the value of the reference voltage $V_{REF}$ is changed rapidly from zero to a maximum value Vrefrating of the reference voltage $V_{REF}$ within a period of time. At a time point of turn-off, the second transistor Q2 receives the second control signal E2 having a low-level value and the first transistor Q1 receives the first control signal E1 having a high-level value, and since the reference voltage $V_{REF}$ previously always has the maximum value Vrefrating, at this time, the first transistor Q1 is enabled, and therefore the reference voltage $V_{REF}$ is decreased quickly to zero.

At a time point when the illuminating device 10 is turned on, the central control unit 2 chooses the night operation mode according to a situation that the detecting unit 1 detects the ambient brightness. At a time point of turn-on, the second transistor Q2 receives the second control signal E2 having a high-level value and the first transistor Q1 receives the first control signal E1 having a low-level value, the second transistor Q2 is enabled by the central control unit 2 until the illuminating device 10 is turned off. As the voltage in the first capacitor C1 cannot be changed rapidly, the reference voltage $V_{REF}$ will be changed slowly from zero to the maximum value Vrefrating of the reference voltage $V_{REF}$. The first capacitor C1 can be discharged by the second resistor R2 because the second transistor Q2 is enabled all the time. A formula of computing the reference voltage $V_{REF}$ is $$Vref(t) = \frac{R2 * Vcc}{R1 + R2} * \left(1 - e^{-\frac{R1+R2}{R1*R2*C1}*t}\right).$$

The duration for increasing the reference voltage $V_{REF}$ depends upon the first capacitor C1, the first resistor R1, the second resistor R2 and the power supply voltage Vcc.

When the illuminating device 10 is turned off, the central control unit 2 detects a turn-off signal. The second transistor Q2 receives the second control signal E2 having a high-level value and the first transistor Q1 receives the first control signal E1 having a preset-level value, the first transistor Q1 is partially enabled, and a current Ic in the first transistor Q1 will be divided at the reference voltage sample terminal $V_{SAMP}$, as a result, the reference voltage $V_{REF}$ is decreased gradually. The duration for decreasing the reference voltage $V_{REF}$ depends upon several factors such as energy stored in the illuminating device 10.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SIGNS

100 control circuit
1 detecting unit
2 central control unit
3 illumination mode control unit
10 illuminating device
31 first control circuit

32 second control circuit
4 compensating circuit
5 power circuit
6 bridge

The invention claimed is:

1. A control circuit for an illuminating device, comprising:
a detecting unit,
a central control unit, and
an illumination mode control unit,
wherein the detecting unit detects ambient brightness and generates a detection signal, the central control unit controls the illumination mode control unit, according to the detection signal, to switch between generating one of:
a plurality of first driving signals enabling the illuminating device to operate in a first illumination mode and
a plurality of second driving signals enabling the illuminating device to operate in a second illumination mode.

2. The control circuit according to claim 1, wherein the second illumination mode is a night operation mode, and in the night operation mode, the second driving signal drives the illuminating device to be turned on or turned off in such a manner that brightness is changed gradually at a time point when the illuminating device is turned on or turned off.

3. The control circuit according to claim 1, wherein the first illumination mode is a daylight operation mode, and in the daylight operation mode, the first driving signal drives the illuminating device to be turned on or turned off within less than 1 second at a time point when the illuminating device is turned on or turned off.

4. The control circuit according to claim 3, wherein when the detection signal is smaller than a first preset value, the central control unit controls the illumination mode control unit to enable the illuminating device to operate in a daylight operation mode, and when the detection signal is bigger than the first preset value, the central control unit controls the illumination mode control unit to enable the illuminating device to operate in a night operation mode.

5. The control circuit according to claim 4, wherein the detecting unit comprises a first serial branch formed by a photoresistive element and a voltage-dividing resistor that are serially connected for detecting the ambient brightness, and the first serial branch has one terminal connected to a power supply voltage and the detection signal can be obtained from the node between the photoresistive element and the voltage-dividing resistor.

6. The control circuit according to claim 3, wherein the central control unit is an MCU.

7. The control circuit according to claim 3, wherein the central control unit receives and compares an operation voltage and a reference voltage representing a driving current of the illuminating device and generates, according to a comparison result, the first driving signal or the second driving signal, wherein the illumination mode control unit is a reference voltage adjusting circuit for adjusting the reference voltage.

8. The control circuit according to claim 7, wherein the reference voltage adjusting circuit controls the reference voltage to be increased gradually at a time point when the illuminating device is turned on in a night operation mode, and controls the reference voltage to be decreased gradually at a time point when the illuminating device is turned off in the night operation mode.

9. The control circuit according to claim 8, wherein the reference voltage adjusting circuit comprises: a first control circuit, and a second control circuit, wherein the central control unit, according to the detection signal, sends a first control signal having variable values to the first control circuit and sends a second control signal having variable values to the second control circuit.

10. The control circuit according to claim 9, wherein the first control circuit and the second control circuit share a second serial branch formed by a first resistor and a second resistor that are serially connected, and a node between the first resistor and the second resistor is a reference voltage sample terminal connected to the central control unit.

11. The control circuit according to claim 10, wherein the second control circuit further comprise: a second transistor and a first capacitor, wherein the first capacitor has one terminal connected to an operation electrode of the second transistor and the other terminal connected to the reference voltage sample terminal, the second transistor has a control electrode connected to the central control unit and a reference electrode connected to a reference potential, and the second transistor receives the second control signal.

12. The control circuit according to claim 11, wherein the first control circuit further comprises: a first transistor, a second capacitor and a fourth resistor, wherein the second capacitor has one terminal connected to a control electrode of the first transistor and the other terminal connected to the reference potential, the control electrode of the first transistor is connected to one terminal of the fourth resistor and the other terminal of the fourth resistor is connected to the central control unit, the first transistor has a reference electrode connected to the reference potential and an operation electrode connected to the reference voltage sample terminal, and the first transistor receives the first control signal.

13. The control circuit according to claim 11, wherein in the night operation mode, at a time point when the illuminating device is turned on, the central control unit sends the first control signal having a low-level value to the first transistor and sends the second control signal having a high-level value to the second transistor, and at a time point when the illuminating device is turned off, the central control unit sends the first control signal having a preset-level value to the first transistor and sends the second control signal having a high-level value to the second transistor.

14. The control circuit according to claim 11, wherein in a daylight operation mode, at a time point when the illuminating device is turned on, the central control unit sends the first control signal having a low-level value to the first transistor and sends the second control signal having a low-level value to the second transistor, and at a time point when the illuminating device is turned off, the central control unit sends the first control signal having a high-level value to the first transistor and sends the second control signal having a low-level value to the second transistor.

15. An illuminating device comprising:
a control circuit, the control circuit comprising:
a detecting unit,
a central control unit, and
an illumination mode control unit,
wherein the detecting unit detects ambient brightness and generates a detection signal, the central control unit controls the illumination mode control unit, according to the detection signal, to switch between generating one of:
a plurality of first driving signals enabling the illuminating device to operate in a first illumination mode and
a plurality of second driving signals enabling the illuminating device to operate in a second illumination mode.

16. The illuminating device according to claim 15, wherein the second illumination mode is a night operation mode, and in the night operation mode, the second driving signal drives the illuminating device to be turned on or turned off in such a manner that brightness is changed gradually at a time point when the illuminating device is turned on or turned off.

17. The illuminating device according to claim 15, wherein the second illumination mode is a night operation mode, and in the night operation mode, the second driving signal drives the illuminating device to be turned on or turned off in such a manner that brightness is changed gradually at a time point when the illuminating device is turned on or turned off.

18. The illuminating device according to claim 16, wherein when the detection signal is smaller than a first preset value, the central control unit controls the illumination mode control unit to enable the illuminating device to operate in a daylight operation mode, and when the detection signal is bigger than the first preset value, the central control unit controls the illumination mode control unit to enable the illuminating device to operate in a night operation mode.

* * * * *